United States Patent [19]

Greever

[11] 3,960,088

[45] June 1, 1976

[54] CASE BONDING COMPOSITE FOR DOUBLE BASE PROPELLANTS

[75] Inventor: Willis L. Greever, LaVale, Md.

[73] Assignee: The United States of America as represented by the Secretary of the Navy, Washington, D.C.

[22] Filed: Feb. 26, 1970

[21] Appl. No.: 18,024

[52] U.S. Cl. ..... 102/103; 149/14; 264/3 R

[51] Int. Cl.[2] ..... F42B 1/00

[58] Field of Search ..... 102/103; 117/45; 149/14; 156/294; 264/3 R

[56] References Cited

UNITED STATES PATENTS

| | | | |
|---|---|---|---|
| 3,213,173 | 10/1965 | Cobb | 102/103 X |
| 3,215,028 | 11/1965 | Pitchford et al. | 102/103 X |
| 3,347,047 | 10/1965 | Hartz et al. | 102/103 X |

*Primary Examiner*—Leland A. Sebastian

[57] ABSTRACT

A two layer composite for case bonding double base propellants. The layer next to the case and internal components comprises a neoprene or vinyl chloride-vinyl acetate copolymer formulation which includes triphenylmethane triisocyanate and the propellant adhesive layer comprises polyvinyl formal cross-linked with titanium acetylacetonate or 2,4-tolylene diisocyanate.

6 Claims, No Drawings

CASE BONDING COMPOSITE FOR DOUBLE BASE PROPELLANTS

BACKGROUND OF THE INVENTION

This invention generally relates to a composite for case bonding double base propellants and more particularly to a two layer composite for case bonding double base propellants.

The function of any case-bond system is to provide a reliable bond of the solid propellant to the case or the insulator over the range of service requirements for the motor. This joint is a point of stress concentration because of the wide dissimilarity in mechanical properties of the propellant and its substrate. Thus, rather than attempt direct coupling, case bonding is generally obtained by using some type of adhesive layer which also acts as the stress transfer medium. In double base work this material is referred to as a "case bond system" or a "bonding layer" while in composite work it is called a "liner". In this application the term "case bond system" as used is meant to refer to any double base propellant system.

Double base propellants use nitrocellulose, nitroglycerin and other plasticizers as the binder for conventional fuels and oxidizers. The ratio of plasticizer to polymer is generally very high. Usually a physical curing of the mass occurs by gelation of the nitrocellulose with the plasticizers.

At the time of casting when the propellant first contacts the substrate, separate liquid-solid phases exist but during the cure these phases progress to a gel and finally to a viscoelastic solid. The migratory solvating action which solidifies the mixture to a homogeneous mass also extends to adjacent materials. Even after the grain is apparently cured migration continues until equilibrium between all phases is attained. The diffusion of the plasticizer over a period of time into surrounding materials, such as the insulator, is a real problem unless a barrier is present to restrict migration and allow a quasi-steady state to be reached. Uncontrolled absorption of binder plasticizers by the case-bond system or the substrate can lead to complete loss of their mechanical properties, insulation features, adhesion or alter the ballistic properties of the motor.

The nitrate esters which form the propellant binder impose a chemical compatibility restriction and limit the materials which can be used in the presence of the propellant. Depending on the material, interactions can result in more or less rapid degradation of the bond interface. Products of incompatibility which are most serious from the standpoint of bond stability are gases, usually oxides of nitrogen.

Propellants must be bonded to a variety of substrates including elastomers such as SBR and EPT, asbestos-filled phenolic compositions, filament-wound epoxy-glass structures and various metals. In some instances more than one type may be included in the same motor. Thus, it is very difficult to obtain case bonding systems which will prevent nitroglycerin migration, be useful on many different substrates and operate efficiently over a wide temperature range and only a limited number of systems will work properly.

SUMMARY OF THE INVENTION

Accordingly, one object of this invention is to provide a case bonding composite or liner for double base propellants.

Another object of this invention is to provide a case bonding composite or liner which prevents or inhibits nitroglycerin migration from the propellant.

Still another object of this invention is to provide a case bonding composite or liner that maintains good physical properties over a temperature range from about −75°F to +175°F.

A further object of this invention is to provide a case bonding composite or liner that is easy to apply and which is very light.

A still further object of this invention is to provide a case bonding composite or liner which can bond propellant to a variety of substrates.

These and other objects of this invention are accomplished by providing a two layer case bonding composite, one layer, next to the case and internal components, comprising a neoprene or vinyl chloride-vinyl acetate (Geon 440×24) formulation which includes triphenylmethane triisocyanate and which acts as a transitional bonding layer and as a barrier to plasticizer migration. The other layer comprises a polyvinyl formal as the principal ingredient as well as a cross-linking agent such as titanium acetylacetonate or 2,4-tolylene diisocyanate and which bonds well to both the neoprene layer and the propellant.

DESCRIPTION OF PREFERRED EMBODIMENT

The concept for case bonding is similar to those used in many other areas of adhesive bonding. In essence, it consists of a substrate primer and a propellant adhesive. The primer serves as the substrate coupling layer and the propellant adhesive serves as the propellant bonding layer. This double layer bonding composite is needed because of the nonreactive chemical nature of the nitrocellulose - nitroglycerin binder and the presence and possible migration effects of the energetic plasticizer.

The substrate coupling layer, applied to the motor case or insulator, is designed to resist plasticization and degradation by the plasticizer and is formulated to chemically bond to the substrate. In general, these properties dictate that the material be chemically dissimilar to the propellant, thus negating the possibility for direct bonding to the propellant. The propellant bonding layer, applied to the coupling layer after proper precure, forms a surface receptive to the propellant. Adhesion of this layer to the coupling layer is obtained by interfacial chemical reaction. Primarily the propellant adheres to the second film by a plasticizer diffusion mechanism during propellant cure. The absorption properties of the propellant-bond layer are adjusted by crosslinking to permit the use of a thin film which attains propellant-like properties after equilibrium plasticizer capacity is reached. Thus, the two film systems form an integral stable joint, chemically bonded, with graded mechanical and chemical properties across the interface.

The substrate coupling layer is the key component of the system since it can provide the following characteristics:

1. proper adhesion to a variety of substrates;
2. control of mechanical properties in case-bond zone to accommodate stress requirements for specific applications;
3. protection of substrates from absorption of energetic plasticizer.

The double layer bonding zone of this invention functions according to the following principles:

1. One layer forms a continuous surface to which the double-base propellant will adhere. The bond is attained primarily by a diffusion mechanism. However, groups can also be provided for chemical linkage. This propellant bonding layer swells and becomes plasticized by casting solvent during propellant cure. When properly cross-linked, the layer maintains its strength and adhesion at a level greater than the cohesive strength of the propellant.

2. A second layer of material couples the propellant bonding layer to the substrate. This layer is designed to resist degradation by casting solvent and also to maintain proper adhesion and stability by interfacial chemical reactivity with adjacent layers. Since this coupling layer does not become plasticized, its characteristic mechanical properties remain almost unchanged.

3. The two layers together form an integral stable joint with the substrate. A "bridge" of graded properties is formed whereby propellant loads are transferred to the insulator or motor case by the thin, continuous-layer bonding system.

Two composites using the double layer method for bonding propellants to a variety of substrates have been developed and evaluated. These composites differ only in the coupling layer material utilized. All materials are solvent solutions and can be applied by conventional techniques such as by spraying or brushing.

sion to the substrate and to the Formvar layer that is subsequently applied to this layer. The triisocyanate is preferably used as a 20% solution in methylene chloride since this is the commercially available product (Mobay Chemical Co.).

Critical features of the system are the choice of solvents and the proper timing of the propellant bond layer application. Solvents for the layers must not be reactive with the isocyanates. In general ketones and chlorinated hydrocarbons suitable for use with isocyanates (i.e., low water and hydroxyl impurities) are best. The systems will tolerate some aromatic hydrocarbons such as toluene and xylene for diluent. A significant portion of the solvent for the propellant bonding layer should also be a solvent for the coupling layer. This layer must be applied before the coupling layer cures to an insoluble state and while isocyanate is still available. This time ranges between 4 and 12 hours.

Geon 440 ×24 type coupler provides excellent bonds to phenolic, fiberglass, cellulose acetate and SBR elastomer-based insulation. The neoprene composition is suitable for use on insulator substrates prepared from SBR, buna-N, polyisoprene and EPT elastomers.

To illustrate the contribution of each layer and the performance of the total case bond system, laboratory data obtained with a typical propellant bonded to a phenolic and an SBR insulator are shown in Table I.

TABLE I

Typical Case Bond Adhesion Properties

| | Case Bond System | | | | | | |
|---|---|---|---|---|---|---|---|
| | Coupler | Propellant Adhesive | Substrate | Test | Temp. (°F) | Resultult (psi) | Failure Location |
| 1. | None | None | styrene-butadiene rubber | Tensile | 77 | ~ 50 | Prop. to styrene-butadiene rubber |
| 2. | | | " | Peel | " | <50 (lb/in) | " |
| 3. | None | X-Linked Formvar | " | Tensile | " | ~110 | " |
| 4. | | X-Linked Formvar | " | Peel | " | <50 (lb/in) | " |
| 5. | Geon/TMTI | " | Phenolic | Tensile | 165 | 61 | Propellant |
| 6. | " | " | " | | 77 | 293 | " |
| 7. | " | " | " | | 0 | 1127 | " |
| 8. | " | " | styrene-butadiene rubber | | 77 | 278 | " |
| 9. | " | " | " | | −65 | 1083 | Test Fixture |
| 10. | " | " | " | Peel | 77 | 177 (lb/in) | Propellant |
| | | | | Creep (10 psi load) | 120 | (1 year) | No Failure |
| 12. | Neoprene/ TMTI | X-Linked Formvar | styrene-butadiene rubber | Tensile | 165 | 68 | Propellant |
| | " | " | " | | 77 | 287 | " |
| | " | " | " | | 0 | 1000 | " |
| | " | " | " | | −65 | >1200 | No Failure |
| | " | " | " | Peel | 77 | 175 (lb/in) | Propellant |
| | " | " | " | Creep (10 psi load) | 120 | (1 year) | No Failure |

NOTE:
The data in this table are for DDP-75 a conventional non-cross-linked CMDB propellant. The Formvar was crosslinked with titanium acetylacetonate.

A polyvinyl formal (Formvar 15/95S, such as made by Monsanto Chem. Co., St. Louis, Mo.) is the preferred propellant bond layer. This is cross-linked either with titanium acetylacetonate or with 2,4-tolylene diisocyanate to improve the aging characteristics by reducing the equilibrium plasticizer absorption capacity Two coupling layer compositions have also been developed. One is a rigid system and the other is a flexible system. The rigid type uses a hydroxyl functional vinyl chloride-vinyl acetate copolymer (such as Geon 440 ×24, B. F. Goodrich Co., Cleveland, Ohio) and the flexible type uses a neoprene elastomer. Both compounds are modified with triphenylmethane triisocyanate (mainly the 4,4′,4″ isomer but the commercial product is a mixture of many isomers) to tailor adhe- The tensile and creep data in these tests were obtained using a truncated cone specimen having the small diameter at the case bond layer, thus concentrating the stress in that area. Peel data were obtained by the climbing drum test method. In this test a flexible substrate is peeled at an angle of about 15° from a mounted propellant strip.

The first four results in the series show the poor bonds obtained by casting propellant directly to an styrene-butadiene rubber insulator and to a Formuar-coated insulator without a coupling layer. The next series of results show the excellent bonds obtained when the Geon coupling layer is used on both a rigid (phenolic) and elastomeric styrene-butadiene rubber substrate. The final series confirms previous data using a neoprene coupler.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLE I

Preparation of Neoprene Stock Solution

The neoprene base mix is prepared on a clean two-roll rubber mill using water cooled rolls (no heat is used). The mill is cleaned by milling a scrap batch of neoprene Ad-10 for 10 to 15 minutes on a mill.

About 100g of neoprene AD-10 is weighed out into a clean wax-free paper cup. About 1.5g of neozone D (phenyl β-naphthylamine) and about 9g of zinc oxide are weighed into a disposable plastic cup and are blended by stirring. A band of neoprene is built on the roll and milled for 3 to 5 minutes until it becomes clear. The blend of Neozone D and zinc oxide is slowly added until it is wetted by the rubber (no dry packets of powder remain) and milling is continued by cutting and stripping to obtain a uniform and thorough mixture. Total milling from time the band is formed is 10 to 12 minutes. The sheet is removed and cut into small pieces or strips. All of this stock is placed in a glass jug or bottle within 2 hours after removal from the mill and about 292g of MEK and 97.5g of MIBK are added. This mixture is then shaken on a shaker until a uniform solution is obtained (8 hours minimum).

The quantities of neozone D (phenyl β-naphthylamine) that can be used with 100g of neoprene AD-10 range from about 1 to 4 g and the zinc oxide varies from 3-12g. The quantities of solvent used are not critical since all the solvents will eventually be evaporated.

EXAMPLE II

Preparation of Vinyl Chloride-Vinyl Acetate Copolymer Stock Solution 10g of vinyl chloride-vinyl acetate copolymer (such as Geon 440 ×24, made by B. F. Goodrich Co., Cleveland, Ohio) is mixed with 20g MEK and 20g toluene till solution is effected.

EXAMPLE III

Preparation of Formvar (Polyvinyl Formal) Stock Solution

About 5g Formvar 15/95S (made by Monsanto Chem. Co., St. Louis, Mo.) is added to a clean glass bottle and 25g of MEK are mixed to form a slurry. About 70g of ethylene dichloride are added and the mixture is shaken vigorously to minimize lump formation. This shaking is continued until a uniform solution is obtained (8 hours minimum) and all the gel disappears.

EXAMPLE IV

Application of Case Bond Composite - Neoprene

A high quality 4 or 6 inch bristle paint brush for applying the case bond system is prepared as follows:

1. soak bristles in a 1/1 mixture (by volume) of ethylene dichloride and MEK for at least 2 hours, changing the solvent at least three times;
2. comb and work the brush as necessary between solvent soaks to remove loose bristles and fragments;
3. flush brush in clean solvent and let it dry in 140°–150°F circulating air oven for about 6 hours.

The chamber is conveniently positioned for brush application of the case bonding system and is preferably arranged in such a manner that the solvent vapors will be drawn away from the operator and exhausted through a hood.

The Neoprene Case Bond Composition consists of

| | |
|---|---|
| Neoprene Stock Solution | 240g |
| Epoxol 9-5 (epoxy type) | 2.4g |
| CKM 1634 (50% in MEK) | 12g |
| 20% solution of triphenylmethane triisocyanate (mainly 4,4′,4″ isomer | 54g |
| MEK/MIBK 3/1 (by weight) | 360g |

This composition is formed by mixing the Neoprene stock solution, Epoxol and CKM 1634 together and adding to this solution of the triisocyanate with the solvents.

A first coat of the Neoprene layer is applied over the interior surfaces of the chamber by brushing with the paint brush. This is allowed to dry for at least 1½ hours at about 80°F with air passing through the chamber before a second coat of the Neoprene formulation is applied. The second coat is allowed to dry about 2–4 hours at around 80°F with air passing through the chamber prior to further case bonding.

The brush is thoroughly cleaned in a solvent mixture composed of three parts (by weight) ethylene dichloride and one part MEK.

The quantities of the various components of this composite can vary over a wide range. Thus, to the 240g of neoprene stock solution can be added from 1–5g of Epoxol 9-5 (epoxy type), from 5-25g CKM 1634 (50% in MEK) and 50–300g 20% solution of triphenylmethane triisocyanate. It is believed that the triphenylmethane triisocyanate is the key component in this formulation.

Furthermore, any other oil soluble phenolic resin can be substituted in place of CKM 1634 (made by Union Carbide Co., New York) and any other epoxy-type stabilizer for neoprene besides Epoxol 9-5 can be used except for MgO.

EXAMPLE V

Application of the Case Bond Composite Vinyl Chloride-Vinyl Acetate Copolymer The solution to be used is prepared by adding to the entire stock solution prepared in Example II 50g triphenylmethane triisocyanate (mainly the 4,4′,4″ isomer), 20g MIBK and 2.5g dibutyl sebacate. This mixture is shaken till solution is attained and is applied exactly as has the neoprene formulation of Example IV.

Additionally varying amounts of components will not render this solution inoperable. Thus, from 10–70g of triphenylmethane triisocyanate and 1–6g of dibutyl sebacate can be used in formulation. Also, other lower dialkyl esters of other dicarboxylic acids can be used in place of dibutyl sebacate such as, for example, diesters of the formula $ROOC\text{-}(CH_2)_n\text{-}COOR'$ wherein R and R′ are lower alkyl and n is in interger from 2 to 10.

EXAMPLE VI

Application of the Case Bond Composite - Polyvinyl Formal

The polyvinyl formal (Formvar) case bond composition is prepared by thoroughly mixing in a clean container in the sequence shown the following materials:

| | |
|---|---|
| Formvar Stock Solution | 540g |
| 2,4-tolylene diisocyanate | 12.6g |
| catalyst solution - dibutyltin dilaurate (1% premixed in ethylene dichloride) | 27 drops |
| Methyl cellosolve acetate | 60g |

Apply a first coat of this solution onto the dried Neoprene coatings and dry for at least 1½ hours at about 80°F with air passing through the chamber. A second coat is also applied and dried for 1 to 2 hours at about 80°F with air passing through the chamber to remove excess solvent. After the completion of the drying cure for at least 16 hours in circulating air at about 140°F.

The constituents of this composition can also vary considerably. Thus, to the 540g of Formvar stock solution one can add 2–16g 2,4-tolylene diisocyanate, 0–270 drops of dibutyltin dilaurate and 0–70g methyl cellosolve acetate.

For crosslinking with titanium acetylacetonate, a stock solution is prepared by dissolving the polyvinyl formal powder in the solvents on a shaker in the following proportions:

| | |
|---|---|
| Formvar 15/95S | 10g |
| Toluene | 60g |
| Ethyl alcohol (95%) | 40g |
| The final formulation prepared at the time of use is: | |
| Formvar Stock Solution (above) | 100g |
| Titanium acetylacetonate | 2g |
| Ethyl lactate | 15g |

This solution is then substituted for the 2,4-tolylene diisocyanate solution in the above example.

Here too, the constituents of the formulation can vary. Thus, one can add to the 100g of stock solution 1–15g titanium acetylacetonate and 0–30g ethyl lactate (which, when used, stabilizes the solution and retards gellation thus increasing the pot life).

What is claimed as new and desired to be secured by Letters Patent of the United States is:

1. A two layer case bonding composite for double base propellants comprising:

1. a first layer comprising neoprene, phenyl β-naphthalamine, zinc oxide, a neoprene stabilizer, an oil soluble phenolic resin and triphenylmethane triisocyanate, and
2. a second layer, bonded to said first layer, comprising polyvinyl formal and a curing agent selected from the group consisting of titanium acetylacetonate and 2,4-tolylene diisocyanate wherein both layers are in the cured state.

2. A case bonding system for double base propellants as described in claim 1 wherein the neoprene containing layer is attached to a material selected from the group consisting of styrene-butadiene rubber, buna-N, polyisoprene and ethylene-propylene terpolymer elastomers.

3. A two layer case bonding composite for double base propellants comprising:

1. a first layer comprising vinyl chloride-vinyl acetate copolymer, triphenylmethane triisocyanate and a lower dialkyl ester of a dicarboxylic acid, and
2. a second layer, bonded to said first layer comprising polyvinyl formal and a curing agent selected from the group consisting of titanium acetylacetonate and 2,4-tolylene diisocyanate wherein both layers are in the cured state.

4. A case bonding composite for double base propellants according to claim 3 wherein the dialkyl ester of a dicarboxylic acid is dibutyl sebacate.

5. A case bonding system for double base propellants as described in claim 3 wherein the vinyl chloride-vinyl acetate containing layer is attached to a material selected from the group consisting of fiberglass, cellulose acetate, styrene butadiene rubber elastomer and phenolic compositions.

6. A case bonding system for double base propellants as described in claim 4 wherein the vinyl chloride-vinyl acetate layer is attached to a material selected from the group consisting of fiberglass, cellulose acetate, styrene-butadiene rubber elastomer and phenolic compositions.

* * * * *